US007114921B2

(12) United States Patent
Iwasaki et al.

(10) Patent No.: US 7,114,921 B2
(45) Date of Patent: Oct. 3, 2006

(54) FAN AND BLOWER UNIT HAVING THE SAME

(75) Inventors: Takahiro Iwasaki, Kariya (JP); Takuya Usami, Kariya (JP)

(73) Assignee: DENSO Corporation, Kariya (JP)

( * ) Notice: Subject to any disclaimer, the term of this patent is extended or adjusted under 35 U.S.C. 154(b) by 95 days.

(21) Appl. No.: 10/940,875

(22) Filed: Sep. 14, 2004

(65) Prior Publication Data

US 2005/0074333 A1 Apr. 7, 2005

(30) Foreign Application Priority Data

Oct. 1, 2003 (JP) ..... 2003-343283

(51) Int. Cl.
*F04D 29/32* (2006.01)
*F01D 25/04* (2006.01)

(52) U.S. Cl. ..... 415/173.6; 415/228; 416/169 A; 416/189

(58) Field of Classification Search ..... 415/119, 415/173.6, 173.1, 228; 416/169 A, 189, 416/190, 192, 195, 500
See application file for complete search history.

(56) References Cited

U.S. PATENT DOCUMENTS 1,724,604 A * 8/1929 Lambert ..... 416/60
3,028,072 A * 4/1962 Atalla ..... 415/91
3,842,902 A * 10/1974 Poslusny ..... 165/51
4,505,641 A * 3/1985 Tsuchikawa et al. ..... 416/189
4,871,298 A * 10/1989 Vera ..... 416/189
5,393,191 A * 2/1995 Alexander ..... 414/537
5,957,661 A * 9/1999 Hunt et al. ..... 416/192
6,024,536 A * 2/2000 Tsubakida et al. ..... 416/189
6,027,307 A 2/2000 Cho et al.

FOREIGN PATENT DOCUMENTS

| | | |
|---|---|---|
| JP | 62-152098 | 9/1987 |
| JP | 3-259000 | 11/1991 |
| JP | 03-259000 | 11/1991 |
| JP | 05-033797 | 2/1993 |
| JP | 5-33797 | 2/1993 |
| JP | 5-15598 | 4/1993 |
| JP | 2002-201944 | 7/2002 |

* cited by examiner

*Primary Examiner*—Igor Kershteyn
(74) *Attorney, Agent, or Firm*—Harness, Dickey & Pierce, PLC

(57) ABSTRACT

A cooling fan includes a cylindrical boss portion, a plurality of blades extending from the boss portion in a radial direction and a ring member integrated with radial outside edges of the blades. The ring member has an axial dimension smaller than an axial dimension of the blade at the radial outside edge, with respect to an axial direction of the boss portion. The ring member has an extending portion extending in a form of bell toward an upstream position of the blades with respect to an air flow. The extending portion is disposed such that a base point connecting to a body portion of the ring member is arranged in a range that begins at a point 25% and ends at a point 85% of a distance from an upstream end of the radial outside edge of the blade with respect to the axial dimension of the blade.

9 Claims, 4 Drawing Sheets

FAN AND BLOWER UNIT HAVING THE SAME

CROSS REFERENCE TO RELATED APPLICATION

This application is based on Japanese Patent Application No. 2003-343283 filed on Oct. 1, 2003, the disclosure of which is incorporated herein by reference.

FIELD OF THE INVENTION

The present invention relates to a fan having a ring member extending in a form of bell at radial outside edges of fan blades and a blower unit having the fan.

BACKGROUND OF THE INVENTION

In a cooling fan for a blower unit, it is proposed to provide a ring member on an outer periphery of fan blades that extend in a radial direction from a cylindrical boss portion. In a propeller fan disclosed in Japanese Utility Application Publication No. JP-U-62-152098, a ring portion is integrally formed with a plurality of blades as an air guide such that the ring portion extends linearly and is in contact with radial outside edges of the blades. The fan does not form a gap between the ring portion and the radial outside edges of the blades, thereby to reduce fan noise. Further, the ring portion forms an extending portion in a form of bell to improve air blowing efficiency and reduce the noise. However, a detailed position of the extending portion with respect to the blades is not suggested in JP-U-62-152098.

SUMMARY OF THE INVENTION

The present invention is made in view of the foregoing matters, and it is an object of the present invention to provide a fan having a ring member on which an extending portion is formed for further improving air blowing efficiency, and a blower unit having the fan.

According to the present invention, a fan has a cylindrical boss portion, a plurality of blades extending from an outer periphery of the boss portion in a radial direction, and a ring member integrated with radial outside edges of the blades. The ring member has an extending portion that extends from a body portion of the ring member in a form of bell toward an upstream position of the blades with respect to an air flow. The ring member has an axial dimension smaller than an axial dimension of the radial outside edge of the blade with respect to an axial direction of the boss portion. The extending portion is disposed such that a base point of the extending portion, which connects to the body portion of the ring member, is arranged in a range that begins at a point 25% of a distance from an upstream end of the radial outside edge of the blade and ends at a point 85% of the distance from the upstream end of the radial outside edge of the blade, with respect to the axial dimension of the blade.

Accordingly, a space between the upstream ends of the blades and the extending portion of the ring member is increased. As a result, the amount of air flowing into the blades in a radial inward direction is increased. Therefore, the air blowing efficiency is improved.

If the base point of the extending portion is arranged much closer to downstream ends of the blades, the radial outside of the downstream portions of the blades are covered with the ring member. As a result, the flow of air discharging in a radial outward direction is blocked. In the present invention, since an upper limit is set to the area in which the base point is arranged, the air blowing efficiency of the cooling fan is further improved.

In a blower unit, the fan is housed in a shroud having a shroud ring portion and an air guide portion extending from the shroud ring portion toward an air upstream position. The fan is preferably arranged such that a base point of the air guide portion is located adjacent to the base point of the extending portion.

Accordingly, the air guide portion of the shroud and the extending portion of the ring member are located downstream of the upstream ends of the fan blades with respect to the air flow. Because a space upstream of the fan is increased, the amount of air sucked into the fan in the radial inside direction is increased. Therefore, the air blowing efficiency is improved in the blower unit.

BRIEF DESCRIPTION OF THE DRAWINGS

Other objects, features and advantages of the present invention will become more apparent from the following detailed description made with reference to the accompanying drawings in which like parts are designated by like reference numbers and in which.

DETAILED DESCRIPTION OF EMBODIMENT

Figure 1:
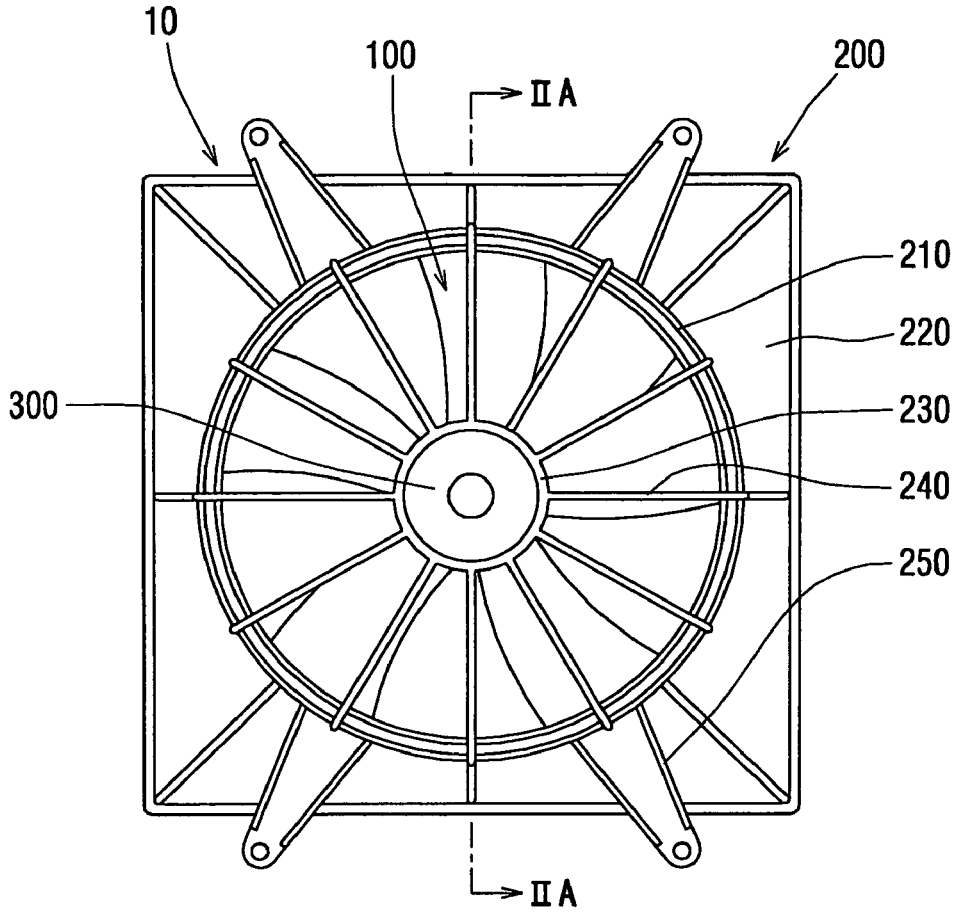
FIG. 1 is a plan view of a blower unit having a cooling fan according to an embodiment of the present invention.

An embodiment of the present invention will be described hereinafter with reference to the drawing.

Figure 2A:
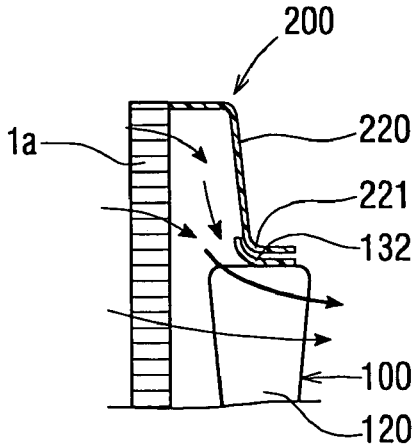
FIG. 2A is a cross-sectional view of the blower unit shown in FIG. 1 taken along a line IIA—IIA.

Referring to FIG. 1, a cooling fan 100 of the present invention is employed in a blower unit (electric fan) 10. The cooling fan 100 is housed in a shroud 200 and driven by a motor 300. The blower unit 10 is fixed to an engine side of a vehicle radiator (not shown) through four fixing portion 250 provided at the corners of the shroud 200. As shown in FIG. 2A, the blower unit 10 produces a flow of cooling air passing through a core portion 1*a* of the radiator. Here, the blower unit 10 is a suction-type so that the cooling air is sucked from a grill of the vehicle to the engine, that is, from the core portion 1*a* of the radiator toward the cooling fan 100.

Figure 3:
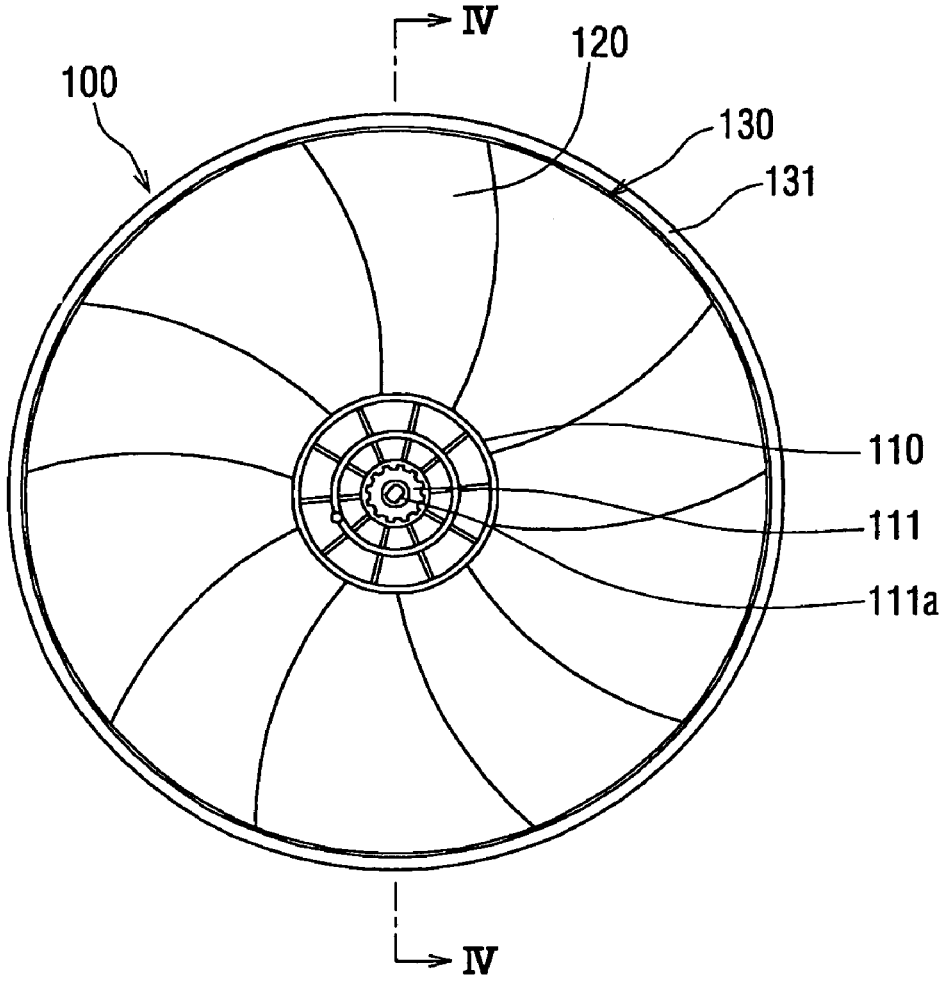
FIG. 3 is a plan view of the cooling fan according to the embodiment of the present invention.
Figure 4:
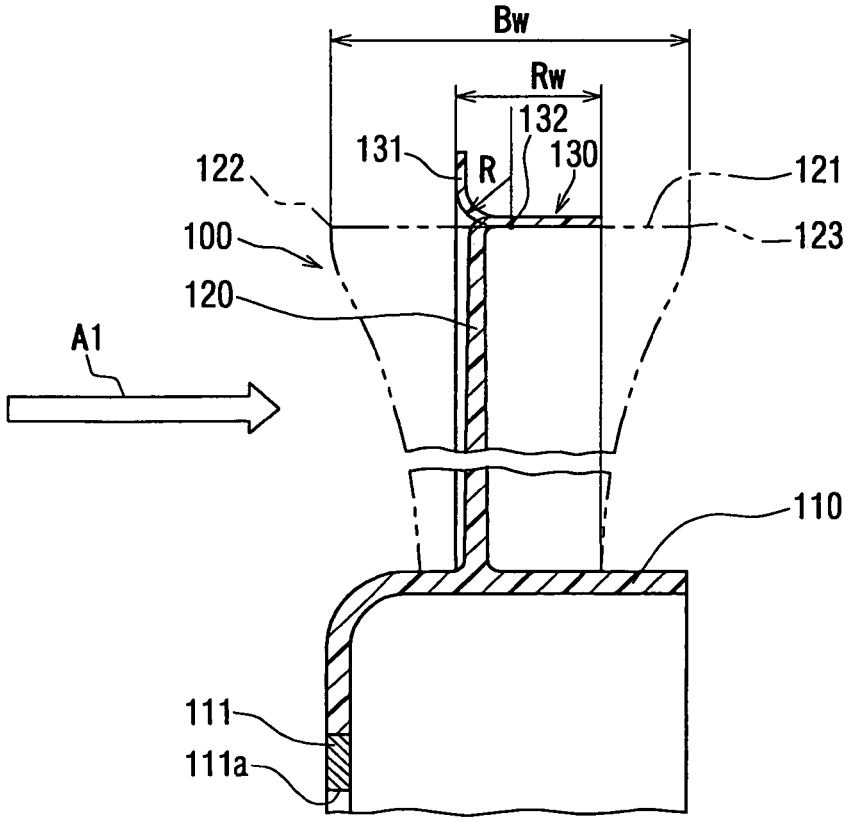
FIG. 4 is a cross-sectional view of the cooling fan shown in FIG. 3 taken along a line IV—IV.

The cooling fan 100 is an axial flow fan. The cooling fan 100 is made of polypropylene including generally 20% of glass fiber. As shown in FIGS. 3 and 4, the cooling fan 100 has a boss portion 110, blades 120, and a ring member 130. The boss portion 110, the blades 120, and the ring member 130 are integrally formed into the cooling fan 100 by injection molding.

The boss portion 110 has a cylindrical shape, an end of which is open and an opposite end of which is closed with a wall. A metal insert 111 is inserted in a middle of the wall, which closes the end of the cylinder, by insert molding. The metal insert 111 is made of aluminum. Further, at the center of the metal insert 111, a shaft hole 111*a* is formed to receive and engage a shaft of the motor 300.

The blades (five blades in the embodiment) 120 are arranged to extend from an outer periphery of the boss portion 110 in a radial direction. An outside diameter of the cooling fan 100 is 340 mm, for example. Regarding the outside diameter of the cooling fan 100, it is generally set within a range between 250 mm and 400 mm, in consideration of mountability to the vehicle and a required air volume.

Figure 5:
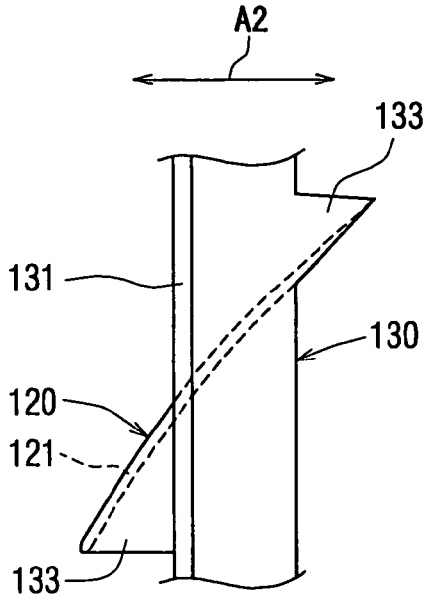
FIG. 5 is a side view of the cooling fan, when viewed from a radial outside, according to the first embodiment of the present invention.

The ring member 130 is located at the radial outside edges 121 of the blades 120. The ring member 130 has a ring width (an axial dimension) Rw smaller than a blade width (an axial dimension) Bw of the blade 120 at the radial outside edge 121, with respect to an axial direction of the boss portion 110. Specifically, a ratio of the ring width Rw to the blade width Bw is in a range between 20% and 80%. In the embodiment, for example, the blade width Bw is 28 mm and the ring width Rw is 13 mm. (i.e., Ring width Rw/Blade width Bw=46%) In FIG. 4, a chain double-dashed line shows a path of the blades 120 while rotating. Also, an arrow A1 denotes a general flow direction or air. In FIG. 5, an arrow A2 denotes the axial direction of the cooling fan 100.

Further, the ring member 130 has an extending portion 131 that extends in a form of bell toward an upstream position of the blade 120 with respect to the air flow. Here, the extending portion 131 extends from an upstream end of a body portion of the ring member 130 in a radial outward direction while curving (portion denoted by R).

Specifically, a ring base point (starting point of the curve R) 132 of the extending portion 131 is arranged in a range encompassing 60% of the blade width Bw, the range beginning at 25% of a distance from an upstream end 122 of the radial outside edge 121 of the blade 120, with respect to an air flow. That is, the ring base point 132 is arranged in a range that begins at a point 25% and ends at a point 85% of the distance from the upstream end 122, with respect to the blade width Bw. More preferably, the base point 132 is arranged in a range that begins at a point 35% and ends at a point 75% of the distance from the upstream end 122 of the radial outside edge 121 of the blade 120. In the embodiment, the base point 132 is arranged at a point substantially 50% of the blade width Bw, as shown in FIG. 4.

Furthermore, connecting walls 133 each having a triangular shape are provided on the radial outside edge 121 of the blade 120 on an upstream position and a downstream position of the ring member 130, as shown in FIG. 5. That is, the connecting walls 133 are provided on an upstream portion and a downstream portion of the radial outside edge 121 of the blade 120, the upstream portion and the downstream portion protruding in the axial direction from an upstream end and a downstream end of the body portion of the ring member 130. The connecting walls 133 extend in the axial direction and connect to the ring member 130.

The shroud 200 shown in FIG. 1 is made of polypropylene including generally 25% to 30% of glass fiber. The fixing portions 250, which are used to mount to the non-illustrated radiator, and respective portions 210 through 240 of the shroud 200 are integrally formed into a single article by injection molding. The shroud 200 has an external shape (for example, rectangular shape) corresponding to the shape of the core portion 1*a* of the radiator. In a substantially middle portion of the shroud 200, a shroud ring portion 210 is formed to surround the cooling fan 100. In a condition that the cooling fan 100 is fixed to the shroud 200 with the motor 300, the shroud ring portion 210 lies on a radial outside of the ring member 130.

An air guide portion 220 is formed between the shroud ring portion 210 and an outer peripheral portion of the shroud 200. The air guide portion 220 extends from the shroud ring portion 210 toward an upstream position of the cooling fan 100 with respect to the air flow. As shown in FIG. 2A, a base point 221 of the air guide portion 220 (a starting point of the air guide portion 220), which connects to the shroud ring portion 210, is located at a position adjacent to the base point 132 of the extending portion 131 of the ring member 130.

A motor holding portion 230, in a form of circle, is formed at a center of the shroud ring portion 210. The motor holding portion 230 is supported by a plurality of motor stays 240 extending in the radial direction and connecting to the shroud ring portion 210.

The motor 300 is fixed to the motor holding portion 230, and the shaft (not shown) of the motor 300 is received in and engaged with the shaft hole 111*a* of the cooling fan 100. Thus, the shaft of the motor 300 and the cooling fan 100 are fixed to each other. Here, the motor 300 is a well known d.c. ferrite motor and is connected to a controller (not shown). The controller is provided to vary an average current value by changing an ON-OFF time ratio of electric current supplied to the motor 300. Thus, rotation speed of the cooling fan 100, which is directly connected to the controller, is varied in accordance with a required cooling performance of the radiator, thereby controlling the amount of air blown by the cooling fan 100.

In the above blower unit 10, the cooling fan 100 is driven by the motor 300, so cooling air is supplied to pass through the core portion 1*a* of the radiator, thereby facilitating radiation of heat of a cooling water flowing through an inside of the radiator.

Because the extending portion 131 provides an effect rectifying air flow in a radial direction of the blades 120, air blowing efficiency can be further improved by adjusting a position of the extending portion 131.

In the embodiment, the base point 132 of the extending portion 131 is arranged in the predetermined range of the radial outside edge 121 of the blade 120 with respect to the blade width Bw. Therefore, a space between the upstream end 122 of the blade 120 and the extending portion 131 of the ring member 130 is increased. Accordingly, the amount of air sucked into the blade 120 in the radially inward direction is increased, and therefore air blowing efficiency is improved.

If the base point 132 of the extending portion 131 is much closer to a downstream end 123 (FIG. 4) of the radial outside edge 121, the downstream portions of the radial outside edges 121 of the blade 120 are closed or covered with the ring member 130. In this case, the flow of air discharging from the cooling fan 100 in a radial outside direction is blocked. On the other hand, in the embodiment, an upper limit (85%) is set to the area in which the base point 132 of the extending portion 131 is arranged. Therefore, the air blowing efficiency is further improved at the downstream position of the cooling fan 100.

Figure 6:
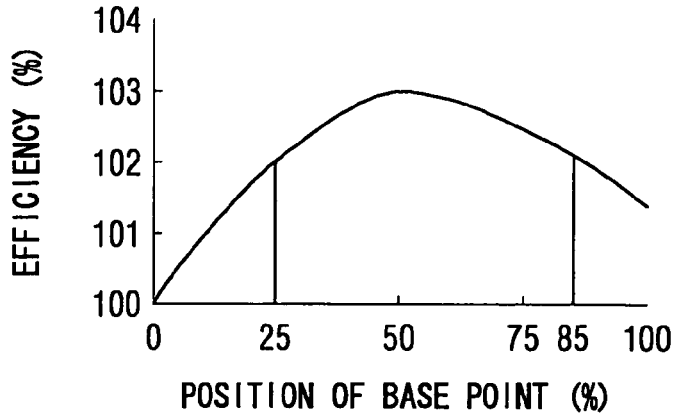
FIG. 6 is a graph showing efficiency of the cooling fan with respect to a position of a base point of a ring member according to the embodiment of the present invention.

FIG. 6 shows a test result regarding efficiency (air blowing efficiency) of the cooling fan 100 with respect to the position of the base point 132 of the extending portion 131. As shown in FIG. 6, when the base point 132 is arranged at the point substantially 50% with respect to the blade width Bw, efficiency of the cooling fan 100 is on the maximum level. Therefore, the point substantially 50% with respect to the blade width Bw is set as an optimum position of the base point 132. Further, the range beginning at the point 25% of the distance from the upstream end 122 of the blade 120 and ends at a point 85% of the distance from the upstream end 122 is set as an applicable range. Furthermore, the range beginning at 35% of the distance from the upstream end 122 of the blade 120 and ends at a point 75% of the distance from the upstream end 122 is set as a more preferable applicable range.

Figure 7:
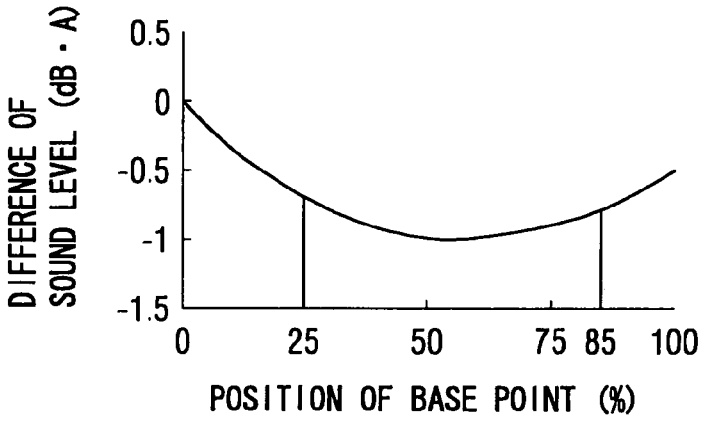
FIG. 7 is a graph showing the difference of sound level with respect to the position of the base point of a ring member according to the embodiment of the present invention.

Further, as shown in FIG. 7, a noise reduction effect is provided with the increase in the air blowing efficiency (increase in the fan efficiency).

Figure 2B:
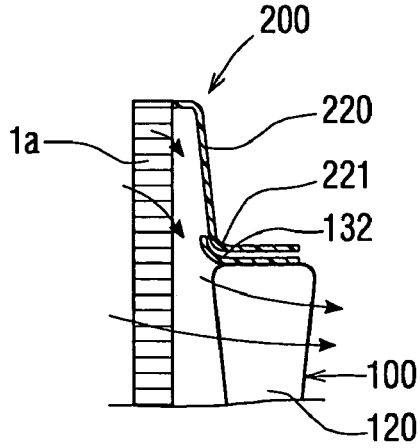
FIG. 2B is a cross-sectional view of a blower unit as a comparison example.

In a condition that the cooling fan 100 is connected to the shroud 200, the base point 221 of the air guide portion 220 of the shroud 200 is located at a position adjacent to the base point 132 of the extending portion 131. Therefore, as shown in FIG. 2A, the air guide portion 220 and the extending portion 131 are arranged downstream from the upstream ends 122 of the blades 120. If the base point 132 of the ring member 130 and the base point 221 of the air guide portion 220 are located upstream from the upstream ends 122 of the blades 120 or adjacent to the upstream ends 122, as shown in FIG. 2B, a space upstream of the cooling fan 100, that is, a space between the core portion 1*a* of the radiator and the air guide portion 220 is small. In this case, it is difficult to facilitate the flow of air upstream of the cooling fan 100. On the other hand, in the embodiment shown in FIG. 2A, because the space upstream of the cooling fan 100 is increased, the air is restricted from stagnating between the core portion 1*a* and the air guide portion 220. Further, the amount of air flowing from the radial outside into the blades 120 is increased, thereby improving the air blowing efficiency.

Figure 8:
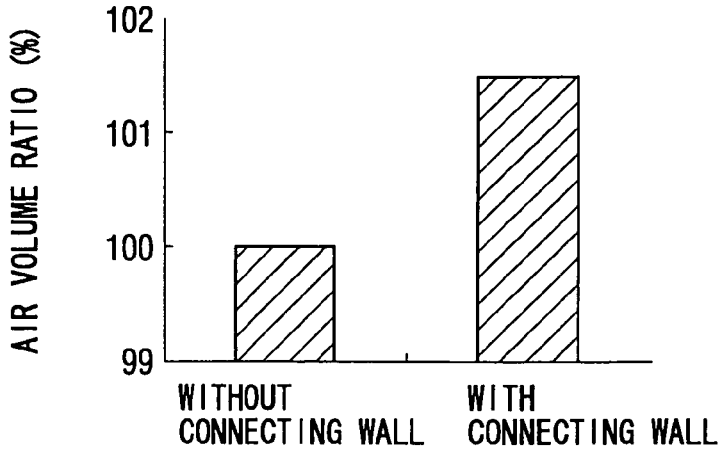
FIG. 8 is a bar graph showing air volume level of the cooling fan when the cooling fan has a connecting wall and when the cooling fan does not have the connecting wall.

Since the connecting walls 133 connecting to the ring member 130 are provided at the radial outside edge 121 of the blade 120 downstream and upstream of the ring member 130, it is less likely that air will leak from a positive side to a negative side at the radial outside edge 121 of the blade 120. Accordingly, the air blowing efficiency is further improved as shown in FIG. 8.

The cooling fan 100 is integrally molded of resin. In molding dies for the cooling fan 100, the portion that an upper molding die and a lower molding die directly slide with each other in a direction that the molding die moves does not exist by the presence of the connecting walls 133. Therefore, the life of the molding dies is improved.

In the above embodiment, the cooling fan 100 is employed in the blower unit 10 that is driven by the electric motor 300. However, the present invention is not limited to the above. For example, the cooling fan 100 of the present invention can be used as an engine fan that is rotated by a driving force of a vehicle engine.

In the above embodiment, the cooling fan 100 is provided to create air flow passing through the radiator 100. However, the purpose of the cooling fan 100 is not limited to the above. The cooling fan 100 can be used for heat exchangers for another purposes, such as a condenser for condensing a refrigerant of an air conditioner, an oil cooler for cooling oil, an inter-cooler for cooling an intake air.

Further, in relation to the improvement of the air blowing efficiency, the connecting wall 133 can be provided on only one of the portion upstream of the ring member 130 and the portion downstream of the ring member 130. Alternatively, the connecting wall 133 can be provided at a part of the radial outside edge 121 of the blade 120 at which the ring member 130 is not formed.

The present invention is not limited to the above embodiments, but may be implemented in other ways without departing from the spirit of the invention.

What is claimed is:

1. A fan comprising:

a boss portion having a cylindrical shape;

a plurality of blades extending from an outer periphery of the boss portion in a radial direction; and a ring member integrated with radial outside edges of the blades, wherein the ring member has an axial dimension smaller than an axial dimension of the blade with respect to an axial direction of the boss portion, the ring member includes a body portion extending in the axial direction of the boss portion and an extending portion extending in a form of bell from an upstream end of the body portion of the ring member toward an upstream position of the blades with respect to an air flow, and the extending portion is disposed such that a downstream end of the extending portion connects to the upstream end of the body portion to form a first base point, the first base point is arranged in a range that begins at a point 25% of a distance from an upstream end of the radial outside edge of the blade and ends at a point 85% of the distance from the upstream end of the radial outside edge of the blade, with respect to the axial dimension of the blade; the fan further comprising:

a connecting wall extending in the axial direction and connecting the body portion of the ring member to at least one of an upstream portion and a downstream portion of the radial outside edge of the blade, the upstream portion and the downstream portion protruding from the body portion of the ring member in the axial direction.

2. The fan according to claim 1, wherein the base point of the extending portion is arranged in a range that begins at a point 35% of the distance from the upstream end of the radial outside edge of the blade and ends at a point 75% of the distance from the upstream end of the radial outside edge of the blade, with respect to the axial dimension of the blade.

3. The fan according to claim 1, wherein the base point of the extending portion is arranged at a point substantially 50% of the distance from the upstream end of the radial outside edge of the blade with respect to the axial dimension of the blade.

4. A blower unit having a fan according to claim 1, comprising:

a shroud housing the fan therein, wherein the shroud has a shroud ring portion extending in the axial direction of the boss portion and an air guide portion extending from an upstream end of the shroud ring portion toward an upstream position with respect to an air flow, the shroud ring portion is located radial outside of the ring member of the fan, and the air guide portion has a downstream end which connects the air guide portion to the upstream end of shroud ring portion to form a second base point, the second base point being located at a position radially outside and adjacent to the first base point of the extending portion of the ring member.

5. The fan according to claim 1, wherein the connecting wall has a triangular shape and extends between an axial end of the body portion of the ring member and the one of the upstream portion and the downstream portion of the radial outside edge of the blade.

6. A fan comprising:

a boss portion having a cylindrical shape;

a plurality of blades extending from an outer periphery of the boss portion in a radial direction; and a ring member integrated with radial outside edges of the blades, wherein the ring member has an axial dimension smaller than an axial dimension of the blade with respect to an axial direction of the boss portion, the ring member includes an annular wall extending generally parallel to the axial direction of the boss portion and an extending portion extending in a form of bell from an upstream end of the annular wall of the ring member toward an upstream position of the blades with respect to an air flow, the extending portion of the ring member includes an annular ring which extends in a direction generally perpendicular to the axial direction of the boss portion and the extending portion is disposed such that a downstream end of the extending portion connects to the upstream end of the annular wall to form a first base point, the first base point is arranged in a range that begins at a point 25% of a distance from an upstream end of the radial outside edge of the blade and ends at a point 85% of the distance from the upstream end of the radial outside edge of the blade, with respect to the axial dimension of the blade a connecting wall extending in the axial direction and connecting to the body portion of the ring member to at least one of an upstream portion and a downstream portion of the radial outside edge of the blade, the upstream portion and the downstream portion protruding from the body portion of the ring member in the axial direction.

7. The fan according to claim 6, wherein the base point of the extending portion is arranged in a range that begins at a point 35% of the distance from the upstream end of the radial outside edge of the blade and ends at a point 75% of the distance from the upstream end of the radial outside edge of the blade, with respect to the axial dimension of the blade.

8. The fan according to claim 6, wherein the base point of the extending portion is arranged at a point substantially 50% of the distance from the upstream end of the radial outside edge of the blade with respect to the axial dimension of the blade.

9. A blower unit having a fan according to claim 6, comprising:

a shroud housing the fan therein, wherein the shroud has a shroud ring portion extending generally parallel to the axial direction of the boss portion and an air guide portion extending from an upstream end of the shroud ring portion toward an upstream position with respect to an air flow, the shroud ring portion is located radial outside of the ring member of the fan, and the air guide portion has a downstream end which connects the air guide portion to the upstream end of shroud ring portion to form a second base point, the second base point being located at a position radially outside and adjacent to the first base point of the extending portion of the ring member.

* * * * *